US005690810A

United States Patent [19]

Lawrence et al.

[11] Patent Number: 5,690,810

[45] Date of Patent: Nov. 25, 1997

[54] SINGLE-STEP PROCESS TO UPGRADE NAPHTHAS TO AN IMPROVED GASOLINE BLENDING STOCK

[75] Inventors: Richard Vance Lawrence, Houston; Pei-Shing Eugene Dai, Port Arthur, both of Tex.

[73] Assignee: Texaco Inc., White Plains, N.Y.

[21] Appl. No.: 338,308

[22] Filed: Nov. 14, 1994

[51] Int. Cl.[6] ..... C10G 47/02

[52] U.S. Cl. ..... 208/135; 208/111; 208/134; 208/137; 208/138; 208/78

[58] Field of Search ..... 208/111, 134, 208/137, 138, 78

[56] References Cited

U.S. PATENT DOCUMENTS 4,789,457 12/1988 Fischer et al. ..... 208/111

4,810,356 3/1989 Grootjans et al. ..... 208/111

5,207,892 5/1993 Vassilakis et al. ..... 208/111

*Primary Examiner*—Helane Myers

*Attorney, Agent, or Firm*—Henry H. Gibson; Carl G. Ries

[57] ABSTRACT

Disclosed is a one-step process intended as an alternative to catalytic reforming which upgrades naphthas by simultaneously saturating aromatics, isomerizing paraffins and selectively cracking heavier hydrocarbons which comprises contacting heavy naphtha feedstock in a reforming zone with a catalyst comprising a solid acid, optionally with a binder of Group III and/or IV of the Periodic Table, having a metal from Group VIII of the Periodic Table deposited thereon, wherein the reaction conditions are much milder than those typically used in catalytic reforming.

24 Claims, No Drawings

SINGLE-STEP PROCESS TO UPGRADE NAPHTHAS TO AN IMPROVED GASOLINE BLENDING STOCK

FIELD OF THE INVENTION

This invention relates to an alternative to catalytic reforming. More particularly, this invention relates to a single-step process to upgrade naphthas, by saturation of aromatics, isomerization of paraffins and selective cracking of heavier hydrocarbons.

BACKGROUND OF THE INVENTION

The Clean Air Amendments of 1990 mandate reformulating the gasoline sold in ozone and CO non-attainment areas. The current model for this reformulated gasoline includes a maximum aromatics content 15% lower than the 1989 base gasoline at a maximum benzene content of 1.0%. It also requires a higher value for the E300—the fraction of the gasoline that boils below 300° F. The new regulations will apply to a large fraction of the gasoline sold in the United States by the year 2000. Catalytic reforming and catalytic cracking, the two major gasoline-producing refinery processes, together provide 60% or more of the gasoline sold. Both of these processes generate gasoline blending stocks that contain high concentrations of benzene and other aromatics. Since the regulations will place an upper limit on the benzene content and on the total aromatic hydrocarbon content of gasoline, a source of low aromatic blending stock is needed. The regulations related to E300 will lower the fraction of gasoline that boils at higher temperatures. This means that processes that convert higher boiling gasoline blending components to lower boiling, low aromatic products will be valuable.

As mentioned, reforming is one of the major gasoline-producing refinery processes. Recently in the art increased reforming severity has been used in attempts to obtain higher octane, however this results in production of increased levels of high-octane aromatics at the expense of low-octane heavy paraffins.

One method of reducing the content of environmentally undesirable aromatic-containing compounds is catalytic aromatic saturation. Several hydrotreating catalysts have been utilized for such operations. A typical catalyst contains hydrogenation metals supported on a porous refractory oxide. This method results in a reduction in octane as well as aromatics. The search continues for better ways to reduce aromatics with less reduction in octane.

To meet newly specified maxima for benzene and aromatics, refiners will probably lower the amount of reformate in gasoline or modify the reforming process. When aromatics are limited, octane will have to come from isoparaffins, naphthenes, or ethers. None of the available processes in the art is exactly suited to meeting these goals.

In isomerization straight-chain hydrocarbons are converted to branched-chain hydrocarbons to increase their suitability for high-octane motor fuels.

In hydrogenation hydrogen is used in the presence of heat, pressure and catalysts to convert, for example, olefinic hydrocarbons to branched-chain paraffins to contribute to high-octane gasoline.

U.S. Pat. No. 3,310,486 teaches the hydrogenation of an olefinic light petroleum distillate over a hydrocracking catalyst (hydrogenation metal on solid acid support). Preferable feed stock contains from 25 to 75 vol % olefinic constituents. In the examples, product distillation end points are all higher than the feed stock. In some of the cited examples the product aromatic content is higher than the feed stock. Initial operating temperature must be above 500° F. Isomerization is not discussed.

U.S. Pat. No. 3,770,845 teaches the hydroisomerization of gasoline-boiling-range paraffins. Reaction temperature is 572° F. or higher. Example feed is $C_8$ or lighter. Aromatics are not specifically mentioned, but benzene concentrations are given in Example III, Table 1.

U.S. Pat. No. 4,647,368 describes a multistep process with a mild hydrocracking step. The product of this particular step is described as containing aromatics, specifically toluene. The product of the mild hydrocracking step is further processed in a standard reforming step in order to increase the concentration of aromatics. One overall objective of the several steps described in U.S. Pat. No. 4,647,368 is to produce a product with more aromatic hydrocarbons than the feed.

U.S. Pat. No. 4,191,634 covers the use of palladium-zeolite catalysts to isomerize a hydrocarbon feed. A slight degree of cracking is described, but no mention is made of aromatics and the feed is specified as having a boiling range of 25° to 70° C.

U.S. Pat. No. 4,962,269 describes the use of palladium or nickel combined with zeolites such as Y or beta or ZSM-20 to isomerize the $C_{10}^{+}$ component of a naphtha which contains 20% or less aromatics. Aromatic compounds are described as undesirable, but those which are easily hydrogenated can be tolerated. The initial boiling point of the feed is 150° C. As part of the process conditions section, the patent states, ". . . there is substantially no conversion to material boiling below . . . about 165° C. (330° F.)."

Typical hydrocracking, as described in WO 91/17829, is performed at higher total pressure and converts a feedstock which contains at least 50% by volume hydrocarbons that boil above the desired end point of the product.

Soon, government regulations will require changes in the composition of gasoline and a reduction in the proportion of aromatics allowed in gasoline. Currently, in many refineries, high octane blending stock is provided by traditional reforming processes which generate aromatic compounds, but when aromatics are limited, octane will have to come from isoparaffins, naphthenes or ethers.

It does not appear that any of the processes available in the art are uniquely suited to producing products with lower benzene and aromatics and lower T90, but with octane equal to or greater than naphtha feedstock. T90 is an alternative to E300 for the measurement of hydrocarbon volatility. T90 is defined as the temperature at which 90 vol % of the liquid has evaporated. It would be desirable in the art if a process were available which produced a decreased amount of benzene and aromatics, but were able to improve octane by the conversion to isoparaffins and naphthenes.

SUMMARY OF THE INVENTION

It is an object of the present invention to provide an alternative process to traditional reforming. A specific object is to provide product naphtha with no benzene, very low concentrations of other aromatics, and a significantly lower T90.

The invention provides a one-step process for converting reformer feedstock which comprises isomerizing normal paraffins and naphthenes to more highly branched isomers with higher octane and selectively hydrocracking higher boiling hydrocarbons to lower boiling compounds which is accomplished by contacting heavy naphtha feedstock in a reaction zone with a catalyst comprising a solid acid support having a metal from Group VIII of the Periodic Table deposited thereon at a temperature of 300°–700° F., a pressure of 50–500 psig, a LHSV of 1–6 volumes of liquid feed to volumes of catalyst per hour and a hydrogen to hydrocarbon mole ratio of 0.5 to 10.

DETAILED DESCRIPTION OF THE INVENTION

In the instant invention it has been found that it is possible to convert a hydrotreated naphtha to a gasoline blending stock that meets new regulations better than traditional reformate. By choosing the proper catalyst and conditions, heavy naphtha feedstock can be converted to a product naphtha with no benzene, very low concentrations of other aromatics, and a significantly lower T90. The proper catalyst is one which combines one or more transition metals capable of catalyzing the hydrogenation/dehydrogenation of hydrocarbons with a strong solid acid. The proper conditions include contacting the naphtha feedstock with the catalyst at 300° to 700° F. under flowing hydrogen at a total pressure of 50 psig or greater. In one step the invented process saturates aromatic compounds to naphthenes, isomerizes normal paraffins and naphthenes to more highly branched isomers with higher octane, and selectively hydrocracks the higher boiling hydrocarbons to lower boiling compounds. The catalyst allows operation of the process at temperatures well below normal reformer temperatures. These lower temperatures produce a shift in the equilibrium to favor the more highly branched hydrocarbons and decrease the likelihood of catalyst deactivation by coking. By operating the process at the higher end of the temperature range, it is possible to produce good yields of isobutane and isopentane, candidate feedstocks for alkylation or etherification.

The process of the instant invention is intended to be an alternative to a catalytic reforming. The instant process accepts as its feedstock the naphthas normally fed to catalytic reformers and converts them to products more suited to the new restrictions on gasoline. The instant process can also accept naphthas with other distillation ranges.

The feedstock for the process can be straight-run, thermal or catalytically cracked naphtha. Naphthas derived from shales, tar sands and coal may also be treated. Typically naphthas boil at 25° to 260° C. While the process can accept any naphtha in this boiling range, it generally shows its greatest advantage on feedstocks which boil between 50° and 260° C.

Since one of the features of the invented process is saturation of aromatic hydrocarbons, the feedstock naphtha will contain aromatic hydrocarbons, generally from 1 to 40 volume per cent. In order to obtain full benefit from the isomerization and cracking functions of the process the feed will also contain from 5 to 40 per cent n-paraffins. Preferred feedstocks will boil between 70° and 250° C. and will contain 5 to 25 percent aromatic hydrocarbons and 10 to 30 percent n-paraffins.

This process converts naphthas to gasoline blending stock by saturating and thus removing benzene and other aromatics, by isomerizing paraffins, and by selectively cracking higher boiling hydrocarbon components. The combination of these three reactions in one process is the essence of the invention. The heavier hydrocarbons are converted to gasoline range and lighter components. One lighter product component, isobutane, is also valuable as feed for alkylation processes. Production of the blending stock is accomplished in a single step at temperatures well below those required for reforming.

The instant process is intended to replace catalytic reforming as a means of preparing gasoline blending stocks from petroleum naphthas. However, because of the catalysts and process conditions used in the invention, it is also related to a lesser degree to other refinery processes. Those processes are $C_5/C_6$ isomerization, hydrocracking and hydrogenation. Conditions for the processes are shown in the table below. Although the invention incorporates some features from each of these, its objectives and process details are distinctly different.

Comparison of Operating Condition Ranges

| Parameter | Invention | Catalytic Reforming | Isomerization | Hydrocracking | Aromatic Hydrogenation |
|---|---|---|---|---|---|
| Feed Composition | $C_5$–$C_{14}$ | $C_7$+ | $C_4$ or $C_5$ & $C_6$ | $C_{20}$+ | $C_7$–$C_{20}$ |
| Pressure, psig | 100–500 | 100–500 | 200–550 | 500–3,000 | 500–800 |
| Temperature, °F. | 400–600 | 900–1,000 | 275–625 | 400–1,000 | 450–700 |
| Recycle Gas Rate, SCF/bbl | 2,000–4,000 | 3,500–6,000 | 1,000–3,000 | 2,000–8,000 | 2,000–4,000 |
| $H_2$ Consumption, SCF/bbl | 100–300 | 500[a] | 50–125 | 100–2,000 | 250–650 |
| Feed LHSV, $hr^{-1}$ | 1–4 | 2–3 | 1–4 | 1–5 | 2–6 |
| Heat of Reaction | Moderately EXO-thermic | Very ENDO-thermic | Slightly EXO-thermic | EXO-thermic | EXO-thermic |

[a]Reforming produces hydrogen

Catalytic Reforming

The principal objective of catalytic reforming is to convert a hydrocarbon feedstock having a gasoline boiling range so as to increase the octane number. The principal net reactions that occur to accomplish this goal are:

1) Dehydrogenation of cyclohexanes to aromatics.
2) Isomerization of alkyl-cyclopentanes to cyclohexanes.
3) Dehydrocyclization of paraffins to aromatics.
4) Isomerization of n-paraffins to isoparaffins.
5) Hydrocracking.

Of these reactions, only hydrocracking is considered to be undesirable. The others are desirable, since they tend to increase the blending octane of the product. In the reforming process hydrocracking is considered undesirable because it lowers the yield of hydrocarbons which boil in the gasoline range.

Conversion is accomplished by mixing hydrogen with the hydrocarbon feed and passing it over a catalyst which contains platinum (and usually some other metal) dispersed on an acidic support, typically a halide-promoted alumina.

In order to favor the production of the high-octane aromatic compounds, the process is operated at temperatures above 900° F. In a literature description of commercial reforming (R. G. Tripp & G. S. Swart, Oil & Gas J., May 11, 1970, page 68) a feedstock with a boiling range of 211° to 350° F. and an aromatic hydrocarbon content of 19.3 liquid volume (LV %) is converted at 190 psig and 4.8 hydrogen to oil mole ratio to a product which contains 2.3 LV % benzene and 84.3 LV % total aromatics.

Isomerization

Of the other three processes, the next most similar to the instant invention is isomerization. Isomerization is generally divided into two areas according to feedstock: $C_4$ isomerization and $C_5/C_6$ isomerization. The $C_5/C_6$ isomerization more closely resembles the instant invention. As was true for reforming, isomerization is similar to the instant invention with respect to many of the reaction parameters. Reaction pressure, hydrogen to oil ratio, and liquid hourly space velocity, are in the same range as the invented process. The catalyst can be similar but best results are obtained from catalysts that are different.

In an example provided in U.S. Pat. No. 3,472,912, the feed is a straight-run naphtha with a boiling range of 90° to 200° F. and an aromatics content of 3.2 wt % before it is hydrotreated. The feed is mixed with hydrogen and passed over a platinum and alumina catalyst which has been activated with carbon tetrachloride. In this example the reaction temperature is between 280° and 330° F., the reaction pressure is 500 psig and the liquid hourly space velocity (LHSV) is 2.0. The product is described as "isomerized hydrocarbons".

In a second U.S. Pat. No. 4,191,634, the broad range for process conditions is described as 245° to 315° C. (473° to 599° F.), pressure is 20 to 54 atm (294 to 794 psig), hydrogen to hydrocarbon ratio is between 3 to 1 and 8 to 1, and the LHSV is 0.5 to 2. The feedstock is described as "paraffinic hydrocarbons boiling in the range of from about 25° to 70° C. (77° to 158° F). This patent describes the use of a two-catalyst bed. The catalysts are palladium dispersed on different acidic zeolites.

Isomerization differs from the instant invention in several important respects:

First, as the description suggests, $C_5/C_6$ isomerization uses only light feeds; and, $C_7$ and higher hydrocarbons are undesirable components of the feed, since they tend to crack to non-gasoline range products. Feedstocks seldom include components heavier than $C_8$. On the other hand, the instant invention (like catalytic reforming) accepts a wider boiling range of hydrocarbons and will accept feedstock with some $C_{12}$ and higher components. In fact, one advantage of the process is that it will convert these higher components to gasoline range material.

Second, the overall objectives are different. The sole intent of isomerization processes is to convert n-paraffins to isoparaffins. The instant invention includes this as a partial objective, however the removal of benzene and aromatics and the cracking of heavier hydrocarbons are at least as important.

Hydrocracking

Some aspects of hydrocracking resemble the other processes under discussion. It employs a catalyst of metal dispersed on an acidic support to convert a hydrocarbon feedstock that has been mixed with hydrogen. Hydrocracking normally employs temperatures between 400° and 1000° F., pressures between 100 and 5000 psig and liquid hourly space velocities between 0.5 and 4. International Patent Application WO 91/17829 describes the preferred ranges for hydrocracking catalyzed by a metal dispersed on a mixed zeolite support: 500° and 800° F., 1000 to 3000 psig, 0.5 to 3.0 LHSV and a $H_2$ to hydrocarbon flow rate ratios between 2 and 8 MSCF/bbl. In British Patent 1,408,758, Example II, a hydrocracking step is carried out over a catalyst described as 0.2 wt % Pt on an acid zeolite. The feedstock was a $C_5$+ hydrocarbon having a final boiling point of 160° C. (320° F.). Conditions for this process were 400° C. (752° F.), 250 psig, LHSV of 2 and $H_2$ to oil ratio of 4. Recovery from the hydrocracking step (Step 4) of the patented scheme was only 87.7 wt %.

Somewhat like isomerization, hydrocracking differs from the instant invention mainly in its objective and feed properties. According to WO 91/17829, "The typical hydrocracking feedstock, however, contains a substantial proportion of components, usually at least 50% by volume, often at least 75% by volume, boiling above the desired end point of the product . . .". Thus, as it is typically practiced, hydrocracking converts a very heavy feedstock into diesel or gasoline range products. The anticipated feed for the instant invention includes only a limited fraction of its total composition that boils above the desired range of the product.

Hydrocracking is used to provide a major change in the boiling range of high boiling feedstocks by forming smaller molecules from larger molecules by inserting hydrogen into carbon-carbon bonds of long-chain hydrocarbons. Because of the lower degree of conversion necessary and the requirement for selectivity, the instant invention operates at temperatures and pressures well below those normally employed for hydrocracking. The invention normally gives yields of $C_5$+ products in excess of 94 wt %, well above those seen with typical hydrocracking. Once again the principal objectives of the two processes differ. The invention cracks only a small fraction of the largest hydrocarbons so as to slightly lower the upper boiling point of a naphtha already close to the desired boiling range. The objectives of the invention also include hydrogenation and removal of aromatics and isomerization of paraffins.

Hydrogenation

Refinery hydrogenation processes are not as well defined as the processes described above. As in all of the processes described above, a hydrocarbon feedstock is mixed with hydrogen and passed over a catalyst at elevated temperatures and pressures. Typical applications are used to improve the stability of distillate products by hydrogenation of olefins, to lower the difference between Research Octane Number and Motor Octane Number for FCC gasolines, or to improve the characteristics of jet or diesel fuel by lowering aromatics content. In the patent literature U.S. Pat. No. 3,779,899 discloses the preparation of a platinum on zeolite catalyst. Conditions for use of the catalyst are given as 250° to 600° F., 150 to 2000 psig, LHSV of 0.5 to 50 $hr^{-1}$, hydrogen to oil ratios of 500 to 10,000 standard cubic feet per barrel. Hydrogenation of gasoline range feedstocks containing high levels of olefins is the subject of U.S. Pat. No. 3,310,485. In this instance the broad range of operation is 500° to 675° F., 100 to 3,000 psig, LHSV of 0.25 to 10 $hr^{-1}$ and hydrogen to hydrocarbon ratios of 1,000 to 10,000. Other technical literature (D. D. Cobb and D. G. Chapel, 50th API Meeting Proceedings V64, pp. 239–247, 1985) describes a process to increase the smoke point of hydrocracker distillate. In an example the aromatics content of the feed is lowered from 34–40 LV % to 15 LV %. Operating ranges are those shown in the table above.

The broad range of conditions are once again similar to the processes, but the objectives are very different. In all of these examples the data and descriptions emphasize that there is little or no hydrocracking. In fact, in U.S. Pat. No. 3,310,485 the T90 increases from feed to product in all but one example and product final boiling points are all higher. Isomerization of paraffins and naphthenes is generally not mentioned. This contrasts with the instant invention where hydrocracking and isomerization are essential features.

THE PRESENT INVENTION

The principal objective of the instant invention is to convert a hydrocarbon feedstock that is in or near the boiling range of gasoline to a product better suited for blending into gasoline. Compared to the feedstock, the product has a lower benzene and aromatic hydrocarbon content, a slightly lower maximum boiling point than the feedstock, and a higher concentration of isoparaffins. Compared to the product from catalytic reforming, the product from the instant process has a much lower content of benzene and aromatics and a slightly lower upper boiling range. When this product is combined with typical gasoline blending stocks from other sources it provides gasoline with a lower aromatic content and lower fraction of high-boiling hydrocarbons. The product of the invention has lower aromatic content than gasoline blended from a reformate from a catalytic reforming process. It is easier for refiners to blend this product into gasoline and meet the new limitations on benzene, aromatics and boiling range.

The naphtha feedstock used in the present process comprises paraffins, naphthenes and aromatics boiling within and above the gasoline range. Feedstocks may include straight run naphthas, natural gasoline, synthetic naphthas, thermal gasoline, catalytically cracked gasoline, partially reformed naphthas or raffinates from extraction or aromatics. Preferably the naphtha feedstock is relatively high boiling. The instant invention converts a high boiling naphtha feedstock to obtain a greater proportion of gasoline than if the feedstock were processed by catalytic reforming alone.

Feedstock Naphtha Properties

| Parameter | Broad | Preferred | Typical |
|---|---|---|---|
| Boiling Range, C. | | | |
| ibp | 25–110 | 35–100 | 70 |
| 10 v % | 50–130 | 65–110 | 80 |
| 50 v % | 70–190 | 100–160 | 130 |
| 90 v % | 110–270 | 130–230 | 180 |
| ep | 150–320 | 170–290 | 240 |
| n-Paraffins v % | 5–40 | 10–30 | 20 |
| Naphthenes v % | 1–50 | 10–40 | 35 |
| Aromatics v % | 1–40 | 5–25 | 16 |

The catalyst of the instant process comprises a solid acidic catalyst having at least one metal selected from Group VIII of the Periodic Table deposited thereon.

The solid acid catalyst should provide acid sites for cracking and isomerization. Within the scope of the invention are synthetically occurring or naturally occurring silicates, which may be acid-treated or crystalline zeolitic aluminosilicates naturally occurring or synthetically prepared in hydrogen form or in a form which has been exchanged with metal cations.

Other solid acid catalysts which would be useful are molecular sieves, pillared clays and super acids of a halide, sulfate, phosphate, nitrate or oxide of a metal of Group IV, V or VI, as discussed in U.S. Ser. No. 08/257,994 (92,043) incorporated herein by reference in its entirety.

The preferred solid acids are acidic zeolites, preferably Y-zeolites, mordenite and β-zeolite. For a description of the structure and uses of β-zeolites see J. B. Higgins et al., Zeolites, 1988, Vol. 8, p. 446; T. C. Tsai and I. Wang, Applied Catalysis, 77, pp. 199 and 209 (1991) and P. A. Parikh et al., Applied Catalysis A, 90.1 (1992).

The zeolites demonstrating the best results were acidic dealuminated Y-zeolites. There are a number of methods known in the art for dealuminating zeolites. A reference which provides an informative overview of the various processes is "Catalytic Materials: Relationship Between Structure And Reactivity", Ed. Whyte, T. E. et al., Ch. 10, American Chemical Society, Washington, D.C., 1984. (Based on the 1983 State-of-the-Art Symposium sponsored by the Division of Industrial and Engineering Chemistry, San Francisco, Calif., Jun 13–16, 1983.)

Each method of dealumination results in a framework modified to a different extent. The resulting zeolite can be not only dealuminized, but in some cases structurally rearranged.

Zeolites that have been dealuminized would produce a zeolite catalyst which provides the desired results. The methods of dealumination which provide the preferred structure in the resulting framework are produced by:

a) Ammonium exchange, followed by calcination;

b) Chelation of alumina by treatment with EDTA, or other amine or carboxylic acid functionalized chelating agent;

c) Treatment of the zeolite with fluorine or a fluorine-containing reactant; and d) Hydrothermal and/or acid treatment.

The preferred zeolite catalysts for use as the support are medium pore, dealuminated faujasite Y-Zeolites, or Beta zeolites in their acidic form. Far less effective are zeolites in their sodium form.

The unit cells of faujasite zeolites are cubic, $a_o \approx 2.5$ nm, and each contains 192 silicon- or aluminum-centered oxygen tetrahedra which are linked through shared oxygen atoms. Because of the net negative charge on each of the aluminum-centered tetrahedra, each unit cell contains an equivalent number of charge-balancing cations. These are exclusively sodium ions in zeolites in their synthesized form. Typical cell contents for the Y-zeolites in the hydrated form are:

$$Na_{56}[(AlO_2)_{56}(SiO_2)_{136}]_r \cdot 250\ H_2O$$

Y-zeolites are distinguished on the basis of the relative concentration of silicon and aluminum atoms and the consequent effects on detailed structure and related chemical and physical properties. The aluminum atoms in the unit cell of Y-zeolite vary from 76 to 48, resulting in a Si:Al ratio between 1.5 and 3.0. Both the cation concentration and charge density on the aluminosilicate structure are lower for Y-zeolites than for X-zeolites, where the aluminum atoms in the unit cell vary from 96 to 77.

The feature which determines the difference between faujasites and other zeolites built up from sodalite units is the double 6-membered ring or hexagonal prism, by which the units are linked. The sodalite unit, or β-cage, can be represented by a truncated octahedron, with the 24 silicon or aluminum atoms(designated T atoms) taking positions at the vertices. The 36 oxygen atoms are displaced from the midpoints of the edges joining the vertices in order to attain tetrahedral configuration around the T atoms. The free diameter of the void within the β-cage is 0.66 nm, but only the smallest molecules can enter through the 0.22 nm diameter opening in the distorted ring of six oxygen atoms associated with each hexagonal face. Each sodalite unit is linked tetrahedrally across hexagonal faces by six bridging oxygens to four other sodalite units. The larger void spaces enclosed by sodalite units and hexagonal prisms are termed α-cages, or supercages. The e-cage is a 26-hedron with a free diameter of ≈1.3 nm, and it can be entered through four distorted 12-member rings of diameter 0.80–0.90 nm. In this way each α-cage is tetrahedrally joined to four others giving a complex system of void space extending throughout the zeolite structure. The α- and β-cages together give Y-zeolites, along with X-zeolites, the largest void volume of any known zeolites, which is ca. 50 vol % of the dehydrated crystal. From the catalytic viewpoint, the α-cages are by far the most important, since, unlike the β-cages, they permit entry of numerous aliphatic and aromatic compounds.

It has been demonstrated in the instant invention that acidic, dealuminized Y-zeolites are particularly effective for the support for the catalyst of the one-step process. Acidity can be introduced into a zeolite in four ways:

a) Ion-exchange with ammonium ion, followed by thermal decomposition.

b) Hydrolysis of ion-exchanged polyvalent cations, followed by partial dehydration.

c) Direct proton exchange.

d) Reduction of exchanged metal ions to a lower valence state.

These methods of zeolite treatment are discussed in more detail by J. M. Thomas and C. R. Theocharis, in "Modern Synthetic Methods" Vol. 5, p 249 (1989), R. Schefford edit.

Said acidic, dealuminized Y-zeolites should then in the application of this invention for one-step treatment of naphtha have a silica-to alumina molar ratio of greater than three, preferably a ratio of 5 or greater and most preferably a silica-to-alumina ratio of 5 to 100. The examples demonstrate the usefulness of catalyst having a silica-to-alumina ratio of 5 to 75.

Examples of suitable commercially-available, dealuminized Y-zeolites include UOP's LZY-82 and LZY-72, PQ Corporation's CP-304-37 and CP-316-26, UOP's Y-85, Y-84, LZ-10 and LZ-210. The examples demonstrate the particular effectiveness of LZY-84. The unit cell size and $SiO_2/Al_2O_3$ molar ratio for these dealuminated Y-zeolites are noted in the following table:

TABLE 1

| ZEOLITE TYPE | UNIT CELL SIZE, A | $SiO_2/Al_2O_3$ MOLAR |
|---|---|---|
| LZY-82 | 24.53 | 7.8 |
| LZY-84 | 24.51 | 8.4 |
| LZY-85 | 24.49 | 9.1 |
| LZY-10 | 24.32 | 23.7 |
| LZY-20 | 24.35 | 18.9 |
| LZ-210 | 24.47 | 9.9 |
| LZY-72 | 24.52 | 8.1 |
| CP316-26 | 24.26 | 45.7 |
| CP304.37 | 24.37 | 11.0 |

The Y-zeolite can be used alone or in combination with a binder, such as a Group III or IV oxide. Oxides used in conjunction with the Y-zeolite include oxides of aluminum, silicon, titanium, zirconium, hafnium, germanium, tin and lead, as well as combinations thereof. Amorphous silica and alumina are preferred. They can be one or the other or a combination of both. Said binders may comprise 10% to 90% of the formed catalyst support.

The metal deposited on the acidic component is preferably selected from Group VIII of the Periodic Table. Suitable Group VIII metals include copper, ruthenium, osmium, cobalt, rhodium, iridium, nickel, palladium and platinum. The Group VIII metals can be deposited as soluble salts or complexes.

Particularly suitable were nickel and palladium. The nickel can be added by impregnation with a halide, oxoanion, or aqueous amine complex of nickel, such as for example nickel nitrate, nickel sulfate, nickel chloride, or nickel amine carbonate in aqueous or alcohol solutions.

The palladium can be added by impregnating the support with an aqueous solution of a palladium complex or salt, such as, for example, tetraamine palladium nitrate. Where palladium is employed a suitable amount is 0.05 to 5.0 wt. % and preferably 0.1 to 1.0 wt. %. Where nickel is employed, a larger amount of metal is suitable. For example, 1 to 20 wt % nickel can be deposited on an acidic catalyst component comprising, for example, a Y-zeolite or a Y-zeolite in combination with an oxide binder of Group IV of the Periodic Table.

Said catalysts may be in the form of powders, pellets, granules, spheres, shapes and extrudates. The examples herein demonstrate the advantage of using spheres and extrudates.

The naphtha feedstock may contact the catalyst in either upflow, downflow or radial-flow mode.

The catalyst is contained in a fixed bed reactor or in a moving bed reactor whereby catalyst may be continuously withdrawn and added. These alternatives are associated with catalyst regeneration options known to those of ordinary skill in the art, such as: (1) a semi-regenerative unit containing fixed bed reactors which maintains operating severity by increasing temperature, eventually shutting the unit down for catalyst regeneration and reactivation; (2) a swing reactor unit, in which individual fixed-bed reactors are serially isolated by manifolding arrangements as the catalyst becomes deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or (4) a hybrid system with a semi-regenerative and continuous-regeneration provisions in the same unit. The preferred embodiment of the present invention is a moving bed reactor with continuous catalyst regeneration.

The process invented herein is similar to reforming in several respects. It uses a similar feedstock and it shares some of the operating parameters. For example, reaction pressures, hydrogen to oil ratios, and liquid hourly space velocities, are in the same range as catalytic reforming. On the other hand, there are major differences between the two. Inlet temperatures for reforming are usually between 900° and 950° F. Inlet temperatures for the instant invention can be as low as 300° F. and are no higher than 700° F. The balance between catalyst dehydrogenation activity and catalyst acidity is different for the two processes. The main difference is between the objectives of the two processes. Reforming is designed to maximize the yield of benzene and aromatics. The instant invention is designed to eliminate benzene and remove a major portion of the other aromatics by saturating them through hydrogenation. The instant invention also includes the objectives of isomerizing paraffins and selectively cracking the higher-boiling components of the feedstock. Thus the purpose of the two processes is completely different.

In the examples which follow it will be noted that:

1. In a typical example of the invention, (Example 7), a naphtha feedstock was combined with hydrogen at a 2.8 to 1 hydrogen to hydrocarbon mole ratio and the mixture was passed over a catalyst comprising 0.5 wt % palladium dispersed on a commercial UOP Y-84 zeolite support (Catalyst D). The naphtha feedstock had a boiling range of 221° to 435° F. and a T90 of 340° F. The reaction temperature was 457° F. Reactor pressure was 300 psig. Total liquid product recovered was 100 wt % of the amount fed.
2. The feed contained 15 wt % aromatics and 0.5 wt % benzene. The liquid product contained 1 wt % total aromatics and <0.02 wt % benzene.
3. Two indicators of selective cracking of the feed are found: 1) the decrease in the T90 (the temperature at which 90 vol % of the liquid has evaporated) from the feed (340° F.) to the product (286° F.) and 2) the decrease in the concentration of hydrocarbons of C11 and greater (C11+) between feed (2.8 wt %) and product (0.1 wt %).
4. Isomerization is partly demonstrated by the decrease in the concentration of total normal paraffins (n-paraffins) from 13 wt % in the feed to 11 wt % in the product. Isomerization is particularly shown by the increase in the isoparaffin concentration from 25 wt % in the feed to 42 wt % in the product.

Additional similar examples are provided in the attached tables.

The extent of conversions in each of the three specified reactions (aromatics hydrogenation, hydrocracking and isomerization) is dependent on the catalyst and the reaction conditions, especially the temperature. In most cases the catalyst and operating temperature are chosen to provide the desired degree of hydrocracking, since the feedstock is closer to the desired degree of conversion for the other two reactions, and because conversion in the other two reactions is more facile, and thus more easily attained.

These data show that the instant invention produces a gasoline blending stock that is better able to meet the new regulations for gasoline than the present reformate produced by catalytic reforming.

Practice of the process of this invention can be illustrated by the following examples and data which is only intended as a means of illustration and it should be understood that the invention is not limited thereby. Those skilled in the art will recognize variations which are within the spirit of the invention.

EXAMPLES DEMONSTRATING INVENTIVE PARAMETERS

The Examples are divided into two categories: descriptions of the preparations of the catalysts used in the process and tables providing process conditions and the compositions of the feedstocks and products. The catalyst preparations are labeled A through I. The Tables of hydrocarbon properties and process conditions are labeled with example identification numbers as well as the catalyst identification letters. Several examples of products formed from each of the catalysts are provided.

Catalyst Preparation

Catalyst A—(HS-10)

This catalyst is a commercially available catalyst for use in isomerizing light hydrocarbons. It contains mordenite and platinum and was obtained from Union Carbide Corporation.

Catalyst B—(6885-03B)

This catalyst is an experimental catalyst comprising about 13% nickel as nickel oxide on 1/16 inch diameter cylindrical support. The support was obtained from PQ Corp. and contains 20% Y-zeolite with the remainder of the support being a silica alumina with a composition of 16% $SiO_2$ and 84% $Al_2O_3$.

The catalyst was prepared in two stages: a nickel ion exchange and a nickel impregnation. For the ion exchange, a nickel nitrate solution was prepared by dissolving 13 g of nickel nitrate hexahydrate in 300 g of deionized water. A 200 g portion of the PQ support described above was added to the solution and the combined solution and support was carefully stirred until the mixture was uniform. This mixture was allowed to stand for 3 hours, then the excess solution was drained and the exchanged support was dried for 17 hours at 120° C.

The nickel impregnation was accomplished by first preparing an aqueous solution of 80 g of nickel nitrate hexahydrate and diluting it to a total solution volume of 70mL. This solution was added to 106 g of the nickel-exchanged material described above. This mixture was carefully stirred until it was uniform and allowed to stand for 10 minutes. It was then dried for 4 hours at 110° C. and calcined at 340° C. for 2.5 hours.

Catalyst C—(6885-06)

This catalyst is an experimental catalyst comprising about 12% nickel as nickel oxide on 1/16 inch diameter cylindrical support. The support is Y-84, a commercially available product, and was obtained from UOP. The support is 1/16 inch diameter extruded pellet which contains at least 60% Y-zeolite with the remainder of the support being binder.

The catalyst was prepared by a single impregnation of the support with nickel nitrate solution. A nickel nitrate solution was prepared which contained 86 g nickel nitrate hexahydrate in a solution volume of 85 mL. This solution was added to 120 g of the Y-84 support. The solution and support were carefully stirred until the mixture was uniform, then allowed to stand for 10 minutes. The extrudates were dried overnight at 120° C., then calcined at 340° C. for 4 hours.

Catalyst D—(6885-12)

This catalyst is an experimental catalyst comprising about 0.5% palladium on the same Y-84 support used for catalyst C.

The catalyst was prepared by a single impregnation of the support with an aqueous solution of ammonium tetrachloropalladate $[(NH_4)_2PdCl_4]$. An aqueous solution was prepared which contained 0.605 g of palladium in 88 mL of solution. This solution was added to 120 g of the UOP Y-84 support. The solution and support were carefully stirred until the mixture was uniform, then allowed to stand for 10 minutes. The extrudates were dried for 2 hours at 110° C., then calcined at 340° C. for 2.5 hours.

Catalyst E—(6873-034)

This catalyst is an experimental catalyst comprising about 0.5% palladium on a 1/16 inch diameter support. The support was obtained from Union Carbide and contains 20% LZ-20, a USY zeolite and 60% S-115, a microporous silica.

The catalyst was prepared by a single impregnation of the support with an aqueous solution of tetraamine palladium nitrate $[(NH_3)_4Pd(NO_3)_2]$. An aqueous solution was prepared from 4.15 g of tetraamine palladium nitrate and 103.5 mL of water. This solution was added to 295.7 g of the support. The solution and support were carefully stirred until the mixture was uniform, dried overnight at 120° C. and then calcined at 540° C. for 5 hours.

Catalyst F—(6885-13)

This catalyst is an experimental catalyst comprising about 0.5% palladium on a support that contains beta zeolite. The support was obtained from PQ Corp.

The catalyst was prepared by a single impregnation of the support with an aqueous solution of ammonium tetrachloropalladate [$(NH_4)_2PdCl_4$ ]. An aqueous solution was prepared which contained 0.605 g of palladium in 120 mL of solution. This solution was added to 120 g of the PQ support. The solution and support were carefully stirred until the mixture was uniform, then allowed to stand for 4 minutes. The extrudates were dried for 1.5 hours at 110° C., then calcined at 340° C. for 2.7 hours.

Catalyst G—(UCI 1305-85A)

This catalyst was obtained from United Catalyst Inc. and comprises 0.5 weight percent platinum on a support which contains USY zeolite.

Catalyst H—(6885-1A)

This catalyst is an experimental catalyst comprising about 0.5% nickel as nickel oxide on 1/16 inch diameter cylindrical support. The support was obtained from PQ Corp. and contains 7% beta zeolite with the remainder of the support being a silica-alumina with a composition of 30% $SiO_2$ and 70% $Al_2O_3$.

The catalyst was prepared by nickel ion exchange. A nickel nitrate solution was prepared by dissolving 13 g of nickel nitrate hexahydrate in 600 mL of de-ionized water. A 200 g portion of PQ support described above was added to the solution and the combined solution and support was carefully stirred until the mixture was uniform. This mixture was allowed to stand for 1.2 hours, then the excess solution was drained and the exchanged support was dried for 2.3 hours at 120° C. The dried material was then calcined at 650° F. for 1.6 hours.

CATALYST I—(6885-1C)

This catalyst is an experimental catalyst comprising about 0.5% nickel as nickel oxide and 6% cobalt on 1/16 inch diameter cylindrical support. The support was obtained from PQ Corp. and contains 7% beta zeolite with the remainder of the support being a silica-alumina with a composition of 30% $SiO_2$ and 70% $Al_2O_3$.

The catalyst was prepared by nickel ion exchange and cobalt nitrate impregnation. A nickel nitrate solution was prepared by dissolving 13 g of nickel nitrate hexahydrate in 600 mL of de-ionized water. A 200 g portion of the PQ support described above was added to the solution and the combined solution and support was carefully stirred until the mixture was uniform. This mixture was allowed to stand for 1.2 hours, then the excess solution was drained and the exchanged support was dried for 2.3 hours at 120° C. The dried material was then calcined at 344° C. for 1.6 hours.

The cobalt impregnation was accomplished by first preparing an aqueous solution of 19 g of cobalt nitrate hexahydrate and diluting it to a total solution volume of 31 mL. This solution was added to 50 g of the nickel-exchanged material described above. This mixture was carefully stirred until it was uniform and allowed to stand for 10 minutes. It was then dried for 1.2 hours at 110° C., and calcined at 346° C. for 2 hours.

Catalyst Test Procedure

Catalyst activity and selectivity to desired products was determined by using the catalysts to convert a suitable hydrocarbon feedstock in the presence of flowing hydrogen. Feedstock properties are given in the tables below. A sample of catalyst (10 to 40 mL) was mixed with a portion of stainless steel shot so that the combined total volume of catalyst and shot was 40 mL. The catalyst and shot mixture was loaded into a stainless steel reactor.

The feedstock used in the examples of the instant invention is hydrotreated naphtha, and is typically characterized by the following composition:

| | |
|---|---|
| Bromine Number | 20–40 |
| Sulfur, ppm | 0.01–0.20 |
| Nitrogen, ppm | 0.2–0.6 |
| Research Octane No. (RON) | 38–42 |
| T10, deg C. | 98–101 |
| T90, deg C. | 170–190 |
| Wt % Aromatics | 13–20 |
| Wt % Isoparaffins | 22–28 |

Before catalyst samples were used to convert hydrocarbons, the catalysts were reduced by introducing flowing hydrogen/nitrogen mixtures to the reactor and raising the temperature to 425° C. with holding periods at two or three intermediate temperatures. Once the temperature had reached 425° C., the gas flow was switched to pure hydrogen and the temperature was maintained for another 2 to 3 hours. Total pressure during reduction was between 5 and 100 psig. At the end of this reduction the hydrogen flow was maintained, and the catalyst temperature was lowered to the temperature appropriate for testing the catalyst.

Each catalyst sample was tested at several different conditions of temperature, total reactor pressure, liquid feed rate and gas feed rate. These are summarized in the tables of results below. Liquid products were collected at room temperature and at reactor pressure.

Catalyst Test Results: Tables of Product Properties

Tables of conditions and properties are labeled with example identification numbers and the catalyst identification letters. In these tables the first column is always the feedstock used for the tests in the table. The tables first give the test conditions and liquid yields. This information is followed by the product properties related to the invention. The tables are presented with the naphtha conversion experiments first, followed by those experiments which employed model feedstocks prepared from solvent grade normal heptane and toluene. Within these two groups the tables are in order of catalyst type.

Aromatics removal is shown by the decrease in the concentration of total aromatics and the decrease or elimination of $C_6$ (benzene) and $C_7$ (toluene) in the products.

Evidence of the isomerization of normal paraffins is provided by the decrease in the concentrations of total $C_7$, $C_{11}$ and $C_{12}$ normal paraffins and the corresponding increase in the concentrations of total $C_4$ and $C_7$ isoparaffins. The examples which employ model feedstocks show very clearly the conversion of normal paraffin to isoparaffins.

Finally, the selective cracking of heavier hydrocarbons and resultant lower concentration of high boiling components is evident in the decrease in the T90 values of the products, the decrease in the concentrations of $C_{11}$+ components of the products and the increase in the concentrations of $C_4$, $C_5$ and $C_6$ components.

EXAMPLE 1, CATALYST A
Feedstock: Hydrotreated Naphtha

| | Feedstock | 0.69 Days | 0.75 Days |
|---|---|---|---|
| Conditions | | | |
| Temperature, °F. | | 477 | 476 |
| LHSV, hr−1 | | 2.1 | 2.1 |
| Reaction Pressure, psig | | 305 | 302 |

-continued

EXAMPLE 1, CATALYST A
Feedstock: Hydrotreated Naphtha

| | Feedstock | 0.69 Days | 0.75 Days |
|---|---|---|---|
| $H_2$/HC Molar Ratio | | 4.3 | 2.6 |
| wt % liquid recovered | | 99% | 100% |
| vol % liquid recovered | | 104% | 104% |
| Product Properties | | | |
| Wt % Aromatics | | | |
| Total | 13 | 2 | 2.6 |
| C6 | 0.3 | 0 | 0 |
| C7 | 4 | 0 | 0 |
| Wt % Normal Paraffins | | | |
| Total | 18 | 15 | 15 |
| C7 | 8 | 5 | 4 |
| C11 | 2.0 | 1.4 | 1.4 |
| C12 | 1.2 | 0.6 | 0.6 |
| Wt % Isoparaffins | | | |
| Total | 26 | 34 | 33 |
| C4 | 0 | 2 | 3 |
| C7 | 5 | 7 | 6 |
| C11 | 1.0 | 0.6 | 0.6 |
| C12 | 0.4 | 0.0 | 0.0 |
| T90, °C. | 178 | 158 | 158 |
| Total wt % Product by Carbon Number | | | |
| C4 | 0.0 | 3 | 3 |
| C5 | 0.5 | 5 | 5 |
| C6 | 5.5 | 8 | 8 |
| C7 | 31.4 | 30 | 30 |
| C11+ | 7.2 | 3.2 | 3.5 |
| C6 to C10 inclusive | 89 | | 87 |

EXAMPLE 2, CATALYST B
Feedstock: Hydrotreated Naphtha

| | Feedstock | 1.0 Days | 7.4 Days | 10.4 Days |
|---|---|---|---|---|
| Conditions | | | | |
| Temperature, °F. | | 497 | 520 | 519 |
| LHSV, hr−1 | | 2.0 | 2.0 | 2.0 |
| Reaction Pressure, psig | | 300 | 300 | 300 |
| $H_2$/HC Molar Ratio | | 3.6 | 3.6 | 3.6 |
| wt % liquid recovered | | 96% | 98% | 97% |
| vol % liquid recovered | | 107% | 104% | 100% |
| Product Properties | | | | |
| Wt % Aromatics | | | | |
| Total | 20 | 4.5 | 5.4 | 6.7 |
| C6 | 0.0 | 0 | 0 | 0 |
| C7 | 5 | 0 | 0 | 0 |
| Wt % Normal Paraffins | | | | |
| Total | 20 | 7 | 7 | 10 |
| C7 | 3.7 | 3.1 | 3.0 | 3.1 |
| C11 | 2.4 | 0.2 | 0.2 | 0.4 |
| C12 | 1.4 | 0.0 | 0.0 | 0.0 |
| Wt % Isoparaffins | | | | |
| Total | 25 | 28 | 27 | 32 |
| C4 | 0 | 4 | 3 | 2 |
| C7 | 0 | 1 | 1 | 1 |
| C11 | 1 | 2 | 1 | 2 |
| T90, °C. | 188 | 162 | 165 | 173 |
| Total wt % Product by Carbon Number | | | | |
| C4 | 0.0 | 4 | 3 | 2 |
| C5 | 0.0 | 4 | 3 | 2 |

-continued

EXAMPLE 2, CATALYST B
Feedstock: Hydrotreated Naphtha

| | Feedstock | 1.0 Days | 7.4 Days | 10.4 Days |
|---|---|---|---|---|
| C6 | 0.0 | 6 | 5 | 2 |
| C7 | 19.2 | 20 | 20 | 19 |
| C11+ | 10.5 | 2.4 | 2.7 | 3.7 |
| C6 to C10 inclusive | 87 | 84 | 85 | 85 |

EXAMPLE 3, CATALYST C
Feedstock: Hydrotreated Naphtha

| | Feedstock | 13.6 Days | 16.6 Days |
|---|---|---|---|
| Conditions | | | |
| Temperature, °F. | | 454 | 453 |
| LHSV, hr−1 | | 2.0 | 2.0 |
| Reaction Pressure, psig | | 305 | 305 |
| $H_2$/HC Molar Ratio | | 2.7 | 2.7 |
| wt % liquid recovered | | 98% | 95% |
| vol % liquid recovered | | 100% | 97% |
| Product Properties | | | |
| Wt % Aromatics | | | |
| Total | 12 | 0.5 | 0.3 |
| C6 | 0.3 | 0 | 0 |
| C7 | 3 | 0 | 0 |
| Wt % Normal Paraffins | | | |
| Total | 33 | 30 | 30 |
| C7 | 10 | 9 | 8 |
| C11 | 0.2 | 0.1 | 0.0 |
| C12 | 0.1 | 0.0 | 0.0 |
| Wt % Isoparaffins | | | |
| Total | 32 | 38 | 38 |
| C4 | 0 | 1.3 | 1.6 |
| C7 | 7 | 7 | 8 |
| C11 | 0 | 0 | 0 |
| C12 | 0.0 | 0.0 | 0.0 |
| T90, °C. | 151 | 147 | 147 |
| Total wt % Product by Carbon Number | | | |
| C4 | 0.0 | 2 | 2 |
| C5 | 0.3 | 2 | 3 |
| C6 | 8.9 | 9.9 | 10.6 |
| C7 | 24.5 | 24.7 | 25.0 |
| C11+ | 0.5 | 0.1 | 0.0 |
| C6 to C10 inclusive | 98 | 95 | 94 |

EXAMPLE 4, CATALYST C
Feedstock: Hydrotreated Naphtha

| | Feedstock | 0.1 Days | 0.5 Days |
|---|---|---|---|
| Conditions | | | |
| Temperature, °F. | | 412 | 480 |
| LHSV, hr−1 | | 2.2 | 2.0 |
| Reaction Pressure, psig | | 303 | 305 |
| $H_2$/HC Molar Ratio | | 2.5 | 2.6 |
| wt % liquid recovered | | 97% | 95% |
| vol % liquid recovered | | 100% | 101% |
| Product Properties | | | |
| Wt % Aromatics | | | |
| Total | 15 | 1.9 | 0.3 |
| C6 | 0.5 | 0 | 0 |

-continued

EXAMPLE 4, CATALYST C
Feedstock: Hydrotreated Naphtha

| | Feedstock | 0.1 Days | 0.5 Days |
|---|---|---|---|
| C7 | 5 | 0 | 0 |
| Wt % Normal Paraffins | | | |
| Total | 13 | 12 | 10 |
| C7 | 6.5 | 5.4 | 3.4 |
| C11 | 0.1 | 0.0 | 0.0 |
| C12 | 0.7 | 0.3 | 0.0 |
| Wt % Isoparaffins | | | |
| Total | 25 | 37 | 43 |
| C4 | 0 | 2 | 6 |
| C7 | 0 | 7 | 10 |
| C11 | 1 | 1 | 0 |
| C12 | 0.1 | 0.2 | 0.0 |
| T90, °C. | 171 | 161 | 130 |
| Total wt % Product by Carbon Number | | | |
| C4 | 0.1 | 3 | 8 |
| C5 | 0.5 | 3 | 10 |
| C6 | 6.9 | 8 | 16 |
| C7 | 31.9 | 29 | 29 |
| C11+ | 2.8 | 2.0 | 0.0 |
| C6 to C10 inclusive | 93 | 87 | 81 |

EXAMPLE 5, CATALYST C
Feedstock: Hydrotreated Naphtha

| | Feedstock | 1.6 Days | 2.0 Days |
|---|---|---|---|
| Conditions | | | |
| Temperature, °F. | | 430 | 424 |
| LHSV, hr−1 | | 2.0 | 2.0 |
| Reaction Pressure, psig | | 300 | 300 |
| $H_2$/HC Molar Ratio | | 3.5 | 3.5 |
| wt % liquid recovered | | 96% | 96% |
| vol % liquid recovered | | 100% | 100% |
| Product Properties | | | |
| Wt % Aromatics | | | |
| Total | 20 | 4.9 | 4.9 |
| C6 | 0.0 | 0 | 0 |
| C7 | 5 | 0 | 0 |
| Wt % Normal Paraffins | | | |
| Total | 20 | 12 | 12 |
| C7 | 3.7 | 3.3 | 3.2 |
| C11 | 2.4 | 0.0 | 0.0 |
| C12 | 1.4 | 0.7 | 0.8 |
| Wt % Isoparaffins | | | |
| Total | 25 | 32 | 32 |
| C4 | 0 | 3 | 3 |
| C7 | 0 | 1 | 1 |
| C11 | 1 | 1 | 1 |
| C12 | 0.3 | 0.0 | |
| T90, °C. | 188 | 164 | 165 |
| Total wt % Product by Carbon Number | | | |
| C4 | 0.0 | 3 | 3 |
| C5 | 0.0 | 3 | 3 |
| C6 | 0.0 | 4 | 4 |
| C7 | 19:2 | 23 | 22 |
| C11+ | 10.5 | 3.9 | 4.0 |
| C6 to C10 inclusive | 87 | 89 | 89 |

EXAMPLE 6, CATALYST C
Feedstock: Hydrotreated Naphtha

| | Feedstock | 1.0 Days | 20.6 Days | 22.9 Days |
|---|---|---|---|---|
| Conditions | | | | |
| Temperature, °F. | | 447 | 499 | 4998 |
| LHSV, hr−1 | | 2.0 | 2.0 | 2.0 |
| Reaction Pressure, psig | | 300 | 300 | 300 |
| $H_2$/HC Molar Ratio | | 3.5 | 3.6 | 3.6 |
| wt % liquid recovered | | 96% | 979% | 97% |
| vol % liquid recovered | | 105% | 101% | 98% |
| Product Properties | | | | |
| Wt % Aromatics | | | | |
| Total | 20 | 2.5 | 3.8 | 4.1 |
| C6 | 0.0 | 0 | 0 | 0 |
| C7 | 5 | 0 | 0 | 0 |
| Wt % Normal Paraffins | | | | |
| Total | 20 | 12 | 14 | 15 |
| C7 | 3.7 | 3.0 | 3.4 | 3.2 |
| C11 | 2.4 | 0.0 | 0.0 | 0.0 |
| C12 | 1.4 | 0.1 | 0.5 | 0.6 |
| Wt % Isoparaffins | | | | |
| Total | 25 | 34 | 28 | 32 |
| C4 | 0 | 4 | 0 | 3 |
| C7 | 0 | 3 | 3 | 2 |
| C11 | 1 | 0 | 1 | 1 |
| C12 | 0.3 | 0.0 | 0.0 | 0.0 |
| T90, °C. | 188 | 157 | 161 | 160 |
| Total wt % Product by Carbon Number | | | | |
| C4 | 0.0 | 4 | 0 | 4 |
| C5 | 0.0 | 5 | 2 | 5 |
| C6 | 0.0 | 6 | 6 | 6 |
| C7 | 19.2 | 23 | 24 | 23 |
| C11+ | 10.5 | 1.4 | 3.0 | 2.9 |
| C6 to C10 inclusive | 87 | 88 | 94 | 87 |

EXAMPLE 7, CATALYST D
Feedstock: Hydrotreated Naphtha

| | Feedstock | 1.0 Days | 0.4 Days |
|---|---|---|---|
| Conditions | | | |
| Temperature, °F. | | 457 | 499 |
| LHSV, hr−1 | | 2.0 | 2.0 |
| Reaction Pressure, psig | | 300 | 455 |
| $H_2$/HC Molar Ratio | | 2.8 | 4.6 |
| wt % liquid recovered | | 100% | 99% |
| vol % liquid recovered | | 100% | 102% |
| Product Properties | | | |
| Wt % Aromatics | | | |
| Total | 15 | 1 | 0.3 |
| C6 | 0.5 | 0 | 0 |
| C7 | 5 | 0 | 0 |
| Wt % Normal Paraffins | | | |
| Total | 13 | 11 | 11 |
| C7 | 6 | 5 | 3 |
| C11 | 0.1 | 0.1 | 0.0 |
| C12 | 0.7 | 0.0 | 0.0 |
| Wt % Isoparaffins | | | |
| Total | 25 | 42 | 46 |
| C4 | 0 | 6 | 8 |
| C7 | 5 | 8 | 8 |
| C11 | 1 | 0 | 0 |
| C12 | 0.1 | 0.0 | 0.0 |
| T90, °C. | 171 | 141 | 126 |

-continued

EXAMPLE 7, CATALYST D
Feedstock: Hydrotreated Naphtha

| | Feedstock | 1.0 Days | 0.4 Days |
|---|---|---|---|
| Total wt % Product by Carbon Number | | | |
| C4 | 0.1 | 7 | 10 |
| C5 | 0.5 | 8 | 13 |
| C6 | 6.9 | 13 | 16 |
| C7 | 31.9 | 31 | 30 |
| C11+ | 2.8 | 0.1 | 0.0 |
| C6 to C10 inclusive | 93 | 83 | 76 |

EXAMPLE 8, CATALYST D
Feedstock: Hydrotreated Naphtha

| | Feedstock | 0.3 Days | 1.7 Days |
|---|---|---|---|
| Conditions | | | |
| Temperature, °F. | | 457 | 432 |
| LHSV, hr−1 | | 2.2 | 2.2 |
| Reaction Pressure, psig | | 300 | 300 |
| $H_2$/HC Molar Ratio | | 3.3 | 3.3 |
| wt % liquid recovered | | 98% | 100% |
| vol % liquid recovered | | 101% | 103% |
| Product Properties | | | |
| Wt % Aromatics | | | |
| Total | 17 | 4.5 | 4.8 |
| C6 | 0.0 | 0 | 0 |
| C7 | 5 | 0 | 0 |
| Wt % Normal Paraffins | | | |
| Total | 20 | 12 | 13 |
| C7 | 4.5 | 3.8 | 4.0 |
| C11 | 0.2 | 0.0 | 0.0 |
| C12 | 1.4 | 0.5 | 0.7 |
| Wt % Isoparaffins | | | |
| Total | 27 | 38 | 36 |
| C4 | 0 | 4 | 3 |
| C7 | 0 | 3 | 2 |
| C11 | 1 | 1 | 1 |
| C12 | 0.0 | 0.0 | 0.2 |
| T90, °C. | 181 | 162 | 162 |
| Total wt % Product by Carbon Number | | | |
| C4 | 0.0 | 5 | 4 |
| C5 | 0.0 | 4 | 3 |
| C6 | 0.0 | 3 | 2 |
| C7 | 20.9 | 24 | 24 |
| C11+ | 9.3 | 4.1 | 5.4 |
| C6 to C10 inclusive | 89 | 86 | 87 |

EXAMPLE 9, CATALYST A
Feedstock: Toluene and n-Heptane Model Feed

| | Feedstock | 0.07 Days | 1.14 Days | 1.32 Days |
|---|---|---|---|---|
| Conditions | | | | |
| Temperature, °F. | 451 | 449 | 453 | |
| LHSV, hr−1 | 3.7 | 1.0 | 2.5 | |
| Reaction Pressure, psig | 305 | 455 | 303 | |
| $H_2$/HC Molar Ratio | 2.1 | 4.0 | 1.9 | |
| wt % liquid recovered | 96% | 94% | 100% | |
| vol % liquid recovered | 99% | 98% | 102% | |

-continued

EXAMPLE 9, CATALYST A
Feedstock: Toluene and n-Heptane Model Feed

| | Feedstock | 0.07 Days | 1.14 Days | 1.32 Days |
|---|---|---|---|---|
| Product Properties | | | | |
| Wt % Aromatics | | | | |
| Total | 13 | 0 | 0 | 0 |
| C6 | — | 0 | 0 | 0 |
| C7 | 13 | 0 | 0 | 0 |
| Wt % Normal Paraffins | | | | |
| Total | 87 | 54 | 42 | 47 |
| C7 | 87 | 53 | 41 | 46 |
| C11 | — | — | — | — |
| C12 | — | — | — | — |
| Wt % Isoparaffins | | | | |
| Total | 0 | 33 | 46 | 40 |
| C4 | 0 | 2 | 3 | 2 |
| C7 | 0 | 30 | 42 | 37 |
| C11 | — | — | — | — |
| C12 | — | — | — | — |
| T90, °C. | 111 | 98 | 98 | 98 |
| Total wt % Product by Carbon Number | | | | |
| C4 | — | 2 | 3 | 3 |
| C5 | — | 1 | 1 | 1 |
| C6 | — | 1 | 1 | 1 |
| C7 | 100 | 96 | 94 | 95 |
| C11+ | — | — | — | — |
| C6 to C10 inclusive | 100 | 96 | 95 | 96 |

EXAMPLE 10, CATALYST B
Feedstock: Toluene and n-Heptane Model Feed

| | Feedstock | 0.25 Days | 1.12 Days | 1.88 Days |
|---|---|---|---|---|
| Conditions | | | | |
| Temperature, °F. | | 556 | 553 | 558 |
| LHSV, hr−1 | | 2.0 | 2.0 | 1.1 |
| Reaction Pressure, psig | | 455 | 455 | 303 |
| $H_2$/HC Molar Ratio | | 5.0 | 3.1 | 2.8 |
| wt % liquid recovered | | 100% | 100% | 64% |
| vol % liquid recovered | | 102% | 103% | 68% |
| Product Properties | | | | |
| Wt % Aromatics | | | | |
| Total | 13 | 0 | 0 | 0 |
| C6 | — | 0 | 0 | 0 |
| C7 | 13 | 0 | 0 | 0 |
| Wt % Normal Paraffins | | | | |
| Total | 87 | 29 | 29 | 20 |
| C7 | 87 | 26 | 24 | 9 |
| C11 | — | — | — | — |
| C12 | — | — | — | — |
| Wt % Isoparaffins | | | | |
| Total | 0 | 59 | 60 | 74 |
| C4 | 0 | 2 | 2 | 9 |
| C7 | 0 | 54 | 53 | 45 |
| C11 | — | — | — | — |
| C12 | — | — | — | — |
| T90, °C. | 111 | 98 | 98 | 98 |
| Total wt % Product by Carbon Number | | | | |
| C4 | — | 2 | 2 | 10 |
| C5 | — | 0 | 1 | 5 |
| C6 | — | 6 | 10 | 23 |

-continued

EXAMPLE 10, CATALYST B
Feedstock: Toluene and n-Heptane Model Feed

| | Feedstock | 0.25 Days | 1.12 Days | 1.88 Days |
|---|---|---|---|---|
| C7 | 100 | 91 | 87 | 59 |
| C11+ | — | — | — | — |
| C6 to C10 inclusive | 100 | 97 | 96 | 83 |

EXAMPLE 11, CATALYST E
Feedstock: Toluene and n-Heptane Model Feed

| | Feedstock | 0.2 Days | 1.1 Days | 2.1 Days |
|---|---|---|---|---|
| Conditions | | | | |
| Temperature, °F. | | 446 | 557 | 555 |
| LHSV, hr−1 | | 1.8 | 3.0 | 2.8 |
| Reaction Pressure, psig | | 457 | 455 | 457 |
| $H_2$/HC Molar Ratio | | 5.5 | 3.0 | 5.4 |
| wt % liquid recovered | | 100% | 96% | 100% |
| vol % liquid recovered | | 102% | 98% | 103% |
| Product Properties | | | | |
| Wt % Aromatics | | | | |
| Total | 14 | 0 | 0 | 0 |
| C6 | — | 0 | 0 | 0 |
| C7 | 14 | 0 | 0 | 0 |
| Wt % Normal Paraffins | | | | |
| Total | 86 | 83 | 26 | 31 |
| C7 | 86 | 83 | 25 | 30 |
| C11 | — | — | — | — |
| C12 | — | — | — | — |
| Wt % Isoparaffins | | | | |
| Total | 0 | 4 | 60 | 55 |
| C4 | 0 | 0 | 3 | 2 |
| C7 | 0 | 4 | 57 | 52 |
| C11 | — | — | — | — |
| C12 | — | — | — | — |
| T90, °C. | 111 | 101 | 98 | 98 |
| Total wt % Product by Carbon Number | | | | |
| C4 | — | 0 | 3 | 3 |
| C5 | — | 0 | 0.3 | 0.2 |
| C6 | — | 0 | 0.4 | 0.3 |
| C7 | 100 | 100 | 95 | 96 |
| C11+ | — | — | — | — |
| C6 to C10 inclusive | 100 | 100 | 96 | 96 |

EXAMPLE 12, CATALYST F
Feedstock: Toluene and n-Heptane Model Feed

| | Feedstock | 1.0 Days |
|---|---|---|
| Conditions | | |
| Temperature, °F. | | 459 |
| LHSV, hr−1 | | 2.0 |
| Reaction Pressure, psig | | 300 |
| $H_2$/HC Molar Ratio | | 3.0 |
| wt % liquid recovered | | 93% |
| vol % liquid recovered | | 94% |
| Product Properties | | |
| Wt % Aromatics | | |
| Total | 19 | 0 |
| C6 | — | 0 |
| C7 | 19 | 0 |

-continued

EXAMPLE 12, CATALYST F
Feedstock: Toluene and n-Heptane Model Feed

| | Feedstock | 1.0 Days |
|---|---|---|
| Wt % Normal Paraffins | | |
| Total | 80 | 31 |
| C7 | 81 | 31 |
| C11 | — | — |
| C12 | — | — |
| Wt % Isoparaffins | | |
| Total | 0 | 46 |
| C4 | 0 | 3 |
| C7 | 0 | 46 |
| C11 | — | — |
| C12 | — | — |
| T90, °C. | 111 | 98 |
| Total wt % Product by Carbon Number | | |
| C4 | — | 3 |
| C5 | — | 0.1 |
| C6 | — | 0.3 |
| C7 | 100 | 95 |
| C11+ | — | — |
| C6 to C10 inclusive | 100 | 95 |

EXAMPLE 13, CATALYST G
Feedstock: Hydrotreated Naphtha

| | Feedstock | 0.7 Days |
|---|---|---|
| Conditions | | |
| Temperature, °F. | | 470 |
| LHSV, hr−1 | | 2.0 |
| Reaction Pressure, psig | | 305 |
| $H_2$/HC Molar Ratio | | 2.7 |
| wt % liquid recovered | | 93% |
| vol % liquid recovered | | 96% |
| Product Properties | | |
| Wt % Aromatics | | |
| Total | 18 | 0 |
| C6 | 0.0 | 0 |
| C7 | 4 | 0 |
| Wt % Normal Paraffins | | |
| Total | 19 | 15 |
| C7 | 4 | 4 |
| C11 | 2.3 | 0.4 |
| C12 | 1.2 | 0.0 |
| Wt % Isoparaffins | | |
| Total | 23 | 38 |
| C4 | 0 | 12 |
| C7 | 0 | 2 |
| C11 | 2 | 0 |
| C12 | 0.5 | 0.0 |
| T90, °C. | 190 | 131 |
| Total wt % Product by Carbon Number | | |
| C4 | 0.0 | 14 |
| C5 | 0.1 | 11 |
| C6 | 0.0 | 9 |
| C7 | 17.9 | 29 |
| C11+ | 11.5 | 0.4 |
| C6 to C10 inclusive | 84 | 74 |

EXAMPLE 14, CATALYST H
Feedstock: n-Heptane Model Feed

| | Feedstock | 1.1 Days | 1.2 Days |
|---|---|---|---|
| Conditions | | | |
| Temperature, °F. | | 525 | 525 |
| LHSV, hr−1 | | 1.6 | 5.5 |
| Reaction Pressure, psig | | 154 | 448 |
| $H_2$/HC Molar Ratio | | 6.2 | 1.5 |
| wt % liquid recovered | | 84% | 96% |
| vol % liquid recovered | | 87% | 101% |
| Product Properties | | | |
| Wt % Aromatics | | | |
| Total | 0 | 0 | 0 |
| C6 | 0 | 0 | 0 |
| C7 | 0 | 0 | 0 |
| Wt % Normal Paraffins | | | |
| Total | 100 | 86 | 94 |
| C4 | 0 | 0.3 | 0.3 |
| C5 | 0 | 0.5 | 0.2 |
| C6 | 0 | 0.6 | 0.1 |
| C7 | 100 | 84.0 | 93.1 |
| Wt % Isoparaffins | | | |
| Total | 0 | 14 | 6 |
| C4 | 0 | 1.8 | 1.1 |
| C5 | 0 | 0.3 | 0.2 |
| C6 | 0 | 1.0 | 0.2 |
| C7 | 0 | 10.2 | 4.1 |
| T90, °C. | 98 | 98 | 98 |
| Total wt % Product by Carbon Number | | | |
| C4 | — | 2.2 | 1.4 |
| C5 | — | 1.4 | 0.5 |
| C6 | — | 1.7 | 0.3 |
| C7 | 100 | 86 | 94 |
| C11+ | — | — | — |
| C6 to C10 inclusive | 100 | 87 | 94 |

EXAMPLE 15, CATALYST I
Feedstock: n-Heptane Model Feed

| | Feedstock | 0.75 Days | 0.83 Days |
|---|---|---|---|
| Conditions | | | |
| Temperature, °F. | | 547 | 547 |
| LHSV, hr−1 | | 1.0 | 1.1 |
| Reaction Pressure, psig | | 450 | 308 |
| $H_2$/HC Molar Ratio | | 2.9 | 2.7 |
| wt % liquid recovered | | 95% | 87% |
| vol % liquid recovered | | — | — |
| Product Properties | | | |
| Wt % Aromatics | | | |
| Total | 0 | 0 | 0 |
| C6 | 0 | 0 | 0 |
| C7 | 0 | 0 | 0 |
| Wt % Normal Paraffins | | | |
| Total | 100 | 76 | 70 |
| C4 | 0 | 0.4 | 0.5 |
| C5 | 0 | 0.5 | 0.8 |
| C6 | 0 | 0.8 | 1.7 |
| C7 | 100 | 74.3 | 66.5 |
| Wt % Isoparaffins | | | |
| Total | 0 | 23 | 30 |
| C4 | 0 | 0.3 | 0.5 |
| C5 | 0 | 0.1 | 0.1 |

-continued

EXAMPLE 15, CATALYST I
Feedstock: n-Heptane Model Feed

| | Feedstock | 0.75 Days | 0.83 Days |
|---|---|---|---|
| C6 | 0 | 0.2 | 0.6 |
| C7 | 0 | 22.9 | 29.2 |
| T90, °C. | 98 | 98 | 98 |
| Total wt % Product by Carbon Number | | | |
| C4 | — | 0.7 | 1.0 |
| C5 | — | 0.6 | 1.0 |
| C6 | — | 1.0 | 2.2 |
| C7 | 100 | 97 | 96 |
| C11+ | — | — | — |
| C6 to C10 inclusive | 100 | 98 | 98 |

What is claimed is:

1. In a process for converting naphtha feedstock to gasoline blending stock, a method of simultaneously a) decreasing the concentration of total aromatics in the product by saturation of aromatics, b) decreasing the concentration of $C_7$, $C_{11}$ and $C_{12}$ normal paraffins in the product, and c) increasing the concentration of total $C_4$ and $C_7$ isoparaffins by isomerization of normal paraffins to more highly branched isomers by selective hydrocracking, which comprises contacting said naphtha feedstock in a contact zone at a temperature of 300°–700° F., a pressure of 50–500 psig, and an LHSV of 1–6 volumes of liquid feed to volume of catalyst per hour and hydrogen to hydrocarbon mole ratio of 0.5 to 10 with a catalyst comprising a solid acid support comprising at least one zeolite selected from the group consisting of a Y-zeolite, zeolite beta, silcalite, ZSM-5 and mordenite, having deposited thereon a metal selected from Group VIII of the Periodic Table, optionally bound to an oxide of Group III and/or IV of the Periodic Table; and producing a product characterized by reduced benzene and aromatics contents.

2. The one-step process of claim 1 wherein the solid acid support comprises at least one zeolite selected from the group of Y-zeolite, zeolite beta, silicalite, ZSM-5, and mordenite.

3. The process of claim 2 wherein the Y-zeolite is dealuminated and has a Si:Al ratio of between 3 and 25.

4. The process of claim 3 wherein the Y-zeolite has a Si:Al ratio of between 3 and 25.

5. The process of claim 2 wherein the Y-zeolite is bound with 10% to 90% by weight of an oxide of a metal selected from silica or alumina, or silica-alumina.

6. The process of claim 1 wherein the Group VIII metal is selected from the group consisting of iron, ruthenium, osmium, cobalt, rhodium, iridium, nickel, palladium and platinum.

7. The process of claim 1 wherein the Group VIII metal is selected from the group consisting of cobalt, nickel, palladium, or platinum.

8. The process of claim 7 wherein the Group VIII metal is nickel in an amount of 1 to 20% by weight of the catalyst.

9. The process of claim 7 wherein the Group VIII metal is nickel in an amount of 6 to 18% by weight of the catalyst.

10. The process of claim 7 wherein the Group VIII metal is nickel in an amount of 8 to 16% by weight of the catalyst.

11. The Process of claim 7 wherein the Group VIII metal is palladium in an amount of 0.01 to 10% by weight of the catalyst.

12. The Process of claim 7 wherein the Group VIII metal is palladium in an amount of 0.05 to 5% by weight of the catalyst.

13. The process of claim 7 wherein the Group VIII metal is palladium in an amount of 0.1 to 5% by weight of the catalyst.

14. The process of claim 7 wherein the Group VIII metal is platinum in an amount of 0.01 to 10% by weight of the catalyst.

15. The process of claim 7 wherein the Group VIII metal is platinum in an amount of 0.05 to 5% by weight of the catalyst.

16. The process of claim 7 wherein the Group VIII metal is platinum in an amount of 0.1 to 5% by weight of the catalyst.

17. The process of claim 7 wherein the Group VIII metal is cobalt in an amount of 1 to 20% by weight of the catalyst.

18. The process of claim 7 wherein the Group VIII metal is cobalt in an amount of 2 to 15% by weight of the catalyst.

19. The process of claim 7 wherein the Group VIII metal is cobalt in an amount of 3 to 12% by weight of the catalyst.

20. The process of claim 1 wherein the pressure in the contact zone is between 100 and 500 psig.

21. The process of claim 1 wherein the hydrogen to hydrocarbon mole ratio in the contact zone is between 1 and 8.

22. The process of claim 1 wherein the hydrogen to hydrocarbon mole ratio in the contact zone is between 2 and 6.

23. The process of claim 1 wherein the temperature in the contact zone is between 350° and 600° F.

24. The process of claim 1 wherein the temperature in the contact zone is between 400° and 550° F.

* * * * *